US007799379B2

(12) United States Patent
Julnes

(10) Patent No.: US 7,799,379 B2
(45) Date of Patent: Sep. 21, 2010

(54) METHOD OF FORMING DETECTABLE WARNINGS ON SURFACES AND PRODUCTS THEREOF

(75) Inventor: Jon N. Julnes, Snohomish, WA (US)

(73) Assignee: Vanguard ADA Systems of America, Inc., Snohomish, WA (US)

( * ) Notice: Subject to any disclaimer, the term of this patent is extended or adjusted under 35 U.S.C. 154(b) by 921 days.

(21) Appl. No.: 11/582,830

(22) Filed: Oct. 17, 2006

(65) Prior Publication Data

US 2008/0090008 A1 Apr. 17, 2008

(51) Int. Cl.
*B05D 1/32* (2006.01)

(52) U.S. Cl. ..... 427/272; 427/282; 427/136; 404/75; 404/19; 264/31; 264/32

(58) Field of Classification Search ..... None
See application file for complete search history.

(56) References Cited

U.S. PATENT DOCUMENTS

| | | | | |
|---|---|---|---|---|
| 4,715,743 | A | 12/1987 | Schmanski | |
| 5,271,690 | A | 12/1993 | Fennessy, Sr. | |
| 5,320,790 | A | 6/1994 | Lowe | |
| 5,385,770 | A * | 1/1995 | Julnes | 428/195.1 |
| 5,827,009 | A * | 10/1998 | Kokoletsos | 404/75 |
| 6,499,910 | B1 | 12/2002 | Grahmbeek | |
| 2005/0013662 | A1 | 1/2005 | Provenzano, III | |

FOREIGN PATENT DOCUMENTS

| | | |
|---|---|---|
| EP | 0 945 549 A2 | 9/1990 |
| JP | 2001-262524 A | 9/2001 |

OTHER PUBLICATIONS

International Search Report dated Apr. 24, 2008, issued in corresponding Application No. PCT/US2007/080339, filed Mar. 10, 2007.

* cited by examiner

*Primary Examiner*—Frederick J Parker
*Assistant Examiner*—Alex Rolland
(74) *Attorney, Agent, or Firm*—Christensen O'Connor Johnson Kindness PLLC

(57) ABSTRACT

The present disclosure provides a method for producing detectable warnings (16) on substrate surfaces (14), which includes providing a mat (30) with a top surface (38) and a bottom surface (36) and a pattern of mat through holes (34) extending through the mat (30). The through holes (34) comprise a lower portion (44) defining a lower mat opening (33) and an upper portion (32) defining an upper mat opening (35), wherein the upper mat opening (35) is larger in transverse dimension than the lower mat opening (33). The method further includes placing the mat (30) on a substrate surface (14), wherein the bottom surface (36) of the mat (30) is adjacent the substrate surface (14), and injecting into the mat through holes (34) a viscous substance (40) having the ability to cure into a solid. The method further includes removing the mat (30) at the appropriate time to form raised detectable warnings (16) on the substrate surface (14).

19 Claims, 5 Drawing Sheets

METHOD OF FORMING DETECTABLE WARNINGS ON SURFACES AND PRODUCTS THEREOF

BACKGROUND

Detectable warnings, a distinctive surface pattern of domes detectable by cane or underfoot, are used to alert people with vision impairments of their approach to streets and hazardous drop-offs. The ADA Accessibility Guidelines (ADAAG) require these warnings on the surface of curb ramps, which remove a tactile cue otherwise provided by curb faces, and at other areas where pedestrian ways blend with vehicular ways. They are also required along the edges of boarding platforms in transit facilities and the perimeter of reflecting pools.

The technical specifications of the ADA require that detectable warnings on walking surfaces have a specific truncated dome pattern. This unique pattern is intended to provide a consistent and uniform surface that is distinctive from other materials and, therefore, recognizable as a warning to pedestrians that they are approaching a potentially dangerous area. Under the "Revised Draft Guidelines for Accessible Public Rights-of-Way," the ADAAG specifically requires that detectable warnings consist of a surface of truncated domes aligned in a square or radial grid pattern.

SUMMARY

The present disclosure provides a method for producing detectable warnings on substrate surfaces, which includes providing a mat with a top surface and a bottom surface and a pattern of mat through holes extending through the mat. The through holes comprise a lower portion defining a lower mat opening and an upper portion defining an upper mat opening, wherein the upper mat opening is larger in transverse dimension than the lower mat opening. The method further includes placing the mat on a substrate surface, wherein the bottom surface of the mat is adjacent the substrate surface, and injecting into the mat through holes a viscous substance having the ability to cure into a solid. The method further includes removing the mat at the appropriate time to form raised detectable warnings on the substrate surface.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

Figure 1:
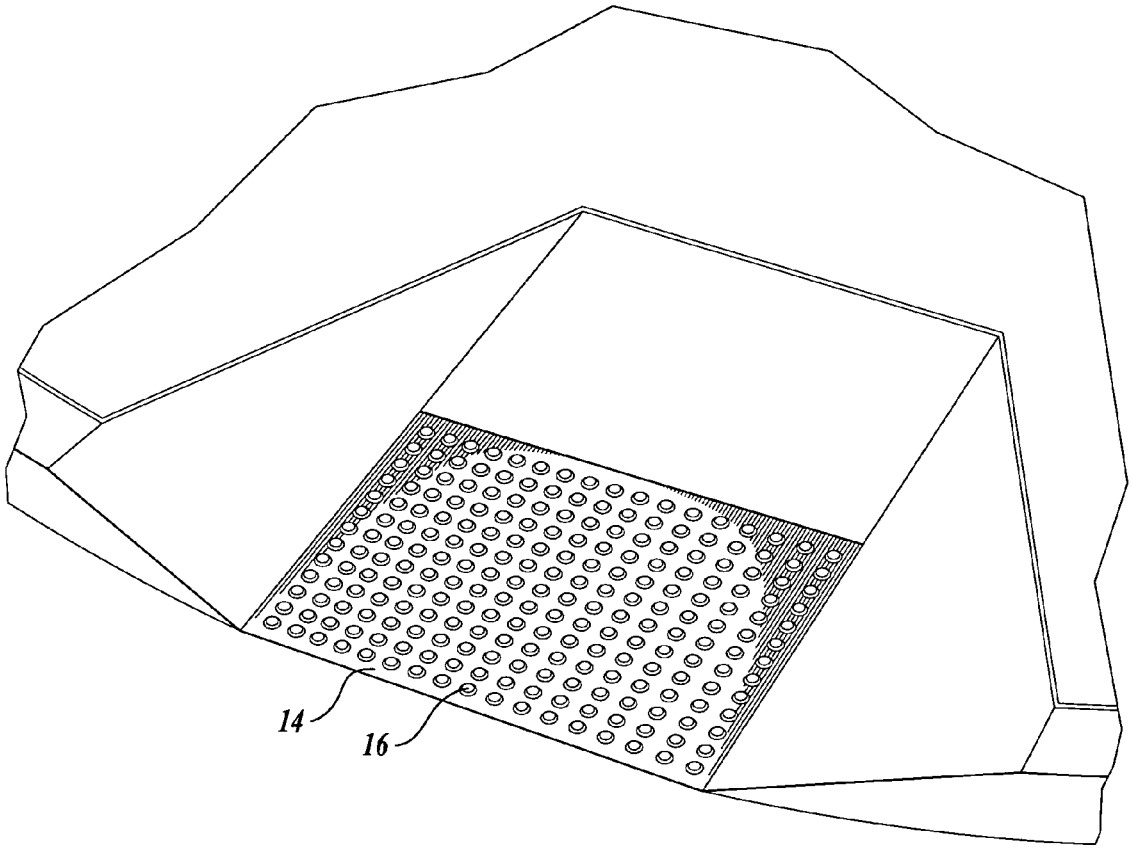
FIG. 1 is a perspective view of detectable warnings formed on a target, substrate surface.

Referring to FIG. 1, a substrate or target surface 14 having a pattern of detectable warnings in the form of truncated domes 16 formed thereon is shown. The truncated domes 16 are illustrated as arranged in an "in-line" or "square" pattern as shown in FIG. 1. The rows of truncated domes may instead be rotated (for example at 45 degrees) in relation to the substrate surface 14 to produce an offset pattern. Preferably, the truncated domes are spaced at least 1.6" from the center of one truncated dome to the center of the adjacent truncated dome, and no more than 2.4" apart for both the in-line pattern and the offset pattern. In addition, a multiple sinusoidal pattern in a stacked relationship, as shown in U.S. Pat. No. 5,385,770, may instead be used to provide a greater likelihood that an object in constant contact with surface 14 will encounter a truncated dome 16 in the shortest distance. For ease of illustration and clarity, only the in-line pattern is shown.

Figure 3A:
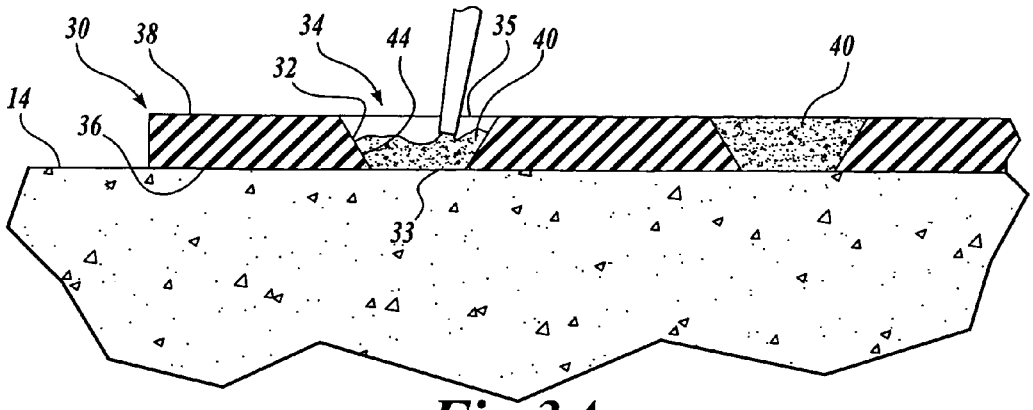
FIG. 3A is a cross-sectional view of blended material being injected into the openings of the mat of FIG. 2.
Figure 3B:
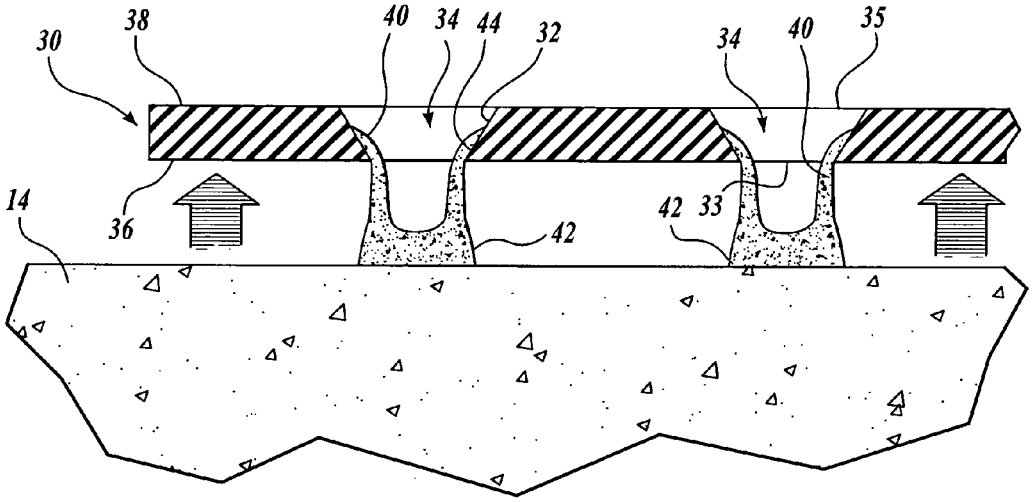
FIG. 3B is a cross-sectional view of the mat of FIG. 3A being removed from the target substrate surface.
Figure 3C:
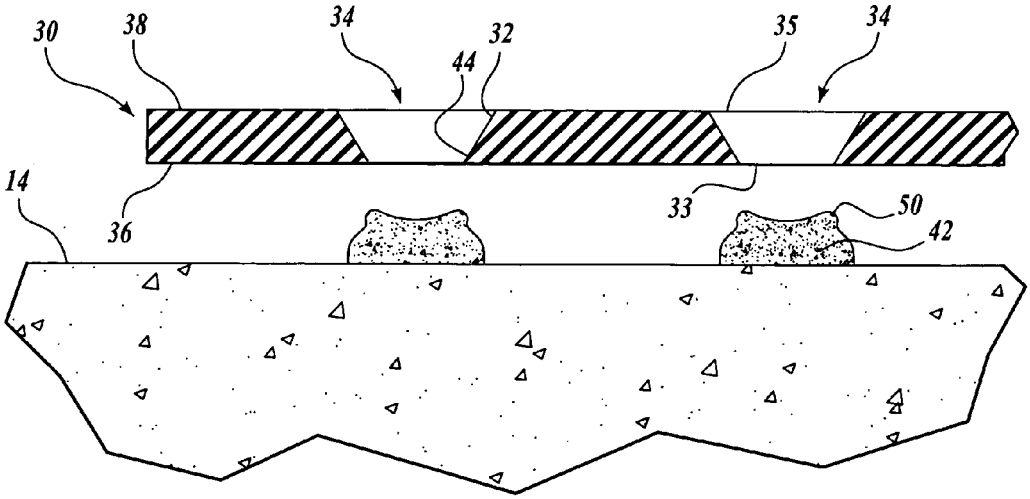
FIG. 3C is a cross-sectional view of the blended material adhered to the target surface after the mat of FIG. 3A has been removed from the target surface.
Figure 3D:
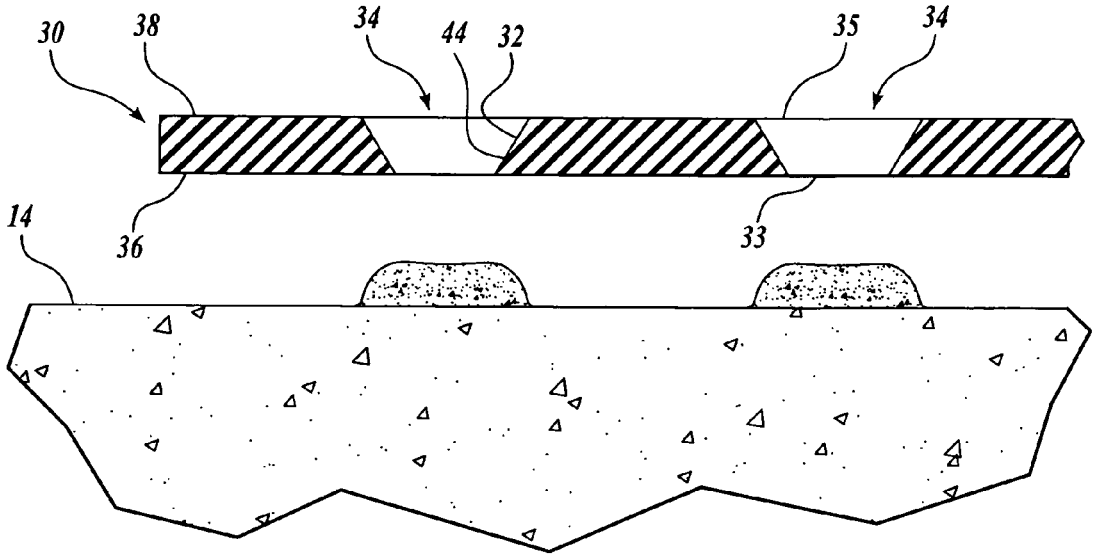
FIG. 3D is a cross-sectional view of the blended material adhered to the target surface, wherein the material has slumped partially to begin forming detectable warnings.
Figure 3E:
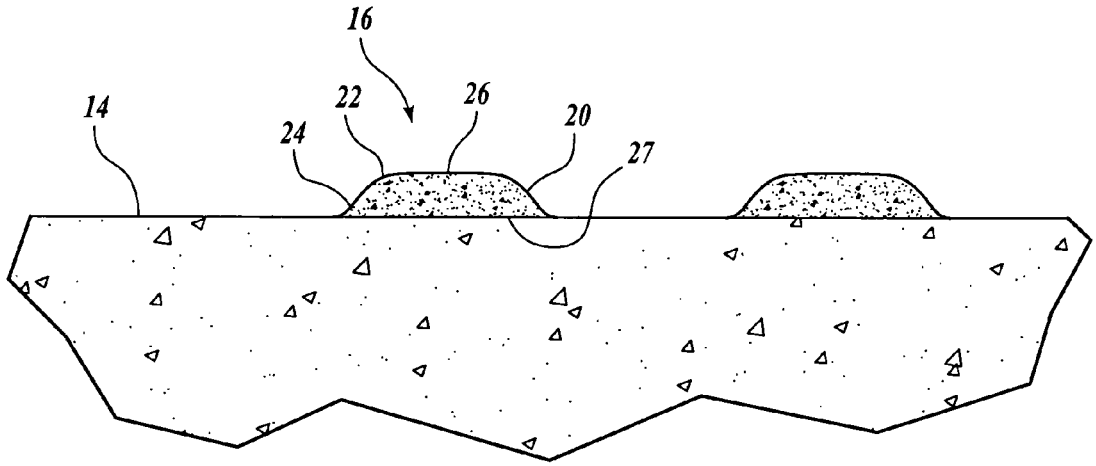
FIG. 3E is a cross-sectional view of detectable warnings formed on a target surface as shown in FIG. 1.

A cross section of a truncated dome 16 bonded to substrate 14 is shown in FIG. 3E. Inclined peripheral surfaces 20 may have curved upper and lower transitions 22 and 24 with upper surface 26 and substrate 14, respectively, so that an object such as a cane, shoe, or foot, as well as an implement such as a shovel or squeegee, will not jam or lodge in the otherwise sharp corners or edges created at these interfaces. Beneficially, these curved transitions 22 and 24 increase the truncated dome's resistance to dislodgment from lateral impacts by permitting a certain degree of impact redirection. To comply with R304.1 (as mentioned in the background section of this application), the truncated domes 16 are at least 0.9" in diameter along the bottom of the truncated dome 16, and no more than 1.4" in total diameter. Along the top of the truncated dome, the diameter is at least 50 percent and no more than 65 percent of the base diameter. The truncated domes 16 are approximately 0.2" in height.

Other truncated shapes and sizes may also be used as detectable warnings. For instance, as shown in U.S. Pat. No. 5,385,770, additional designs may include an elongated elliptical design, a diamond shaped design, an asymmetrical elongated elliptical design, or a dumbbell design. Each detectable warning is characterized as having an inclined peripheral surface and somewhat rounded or curved transitions between both the lower substrate 14 and the upper surface of the detectable warning.

Figure 2:
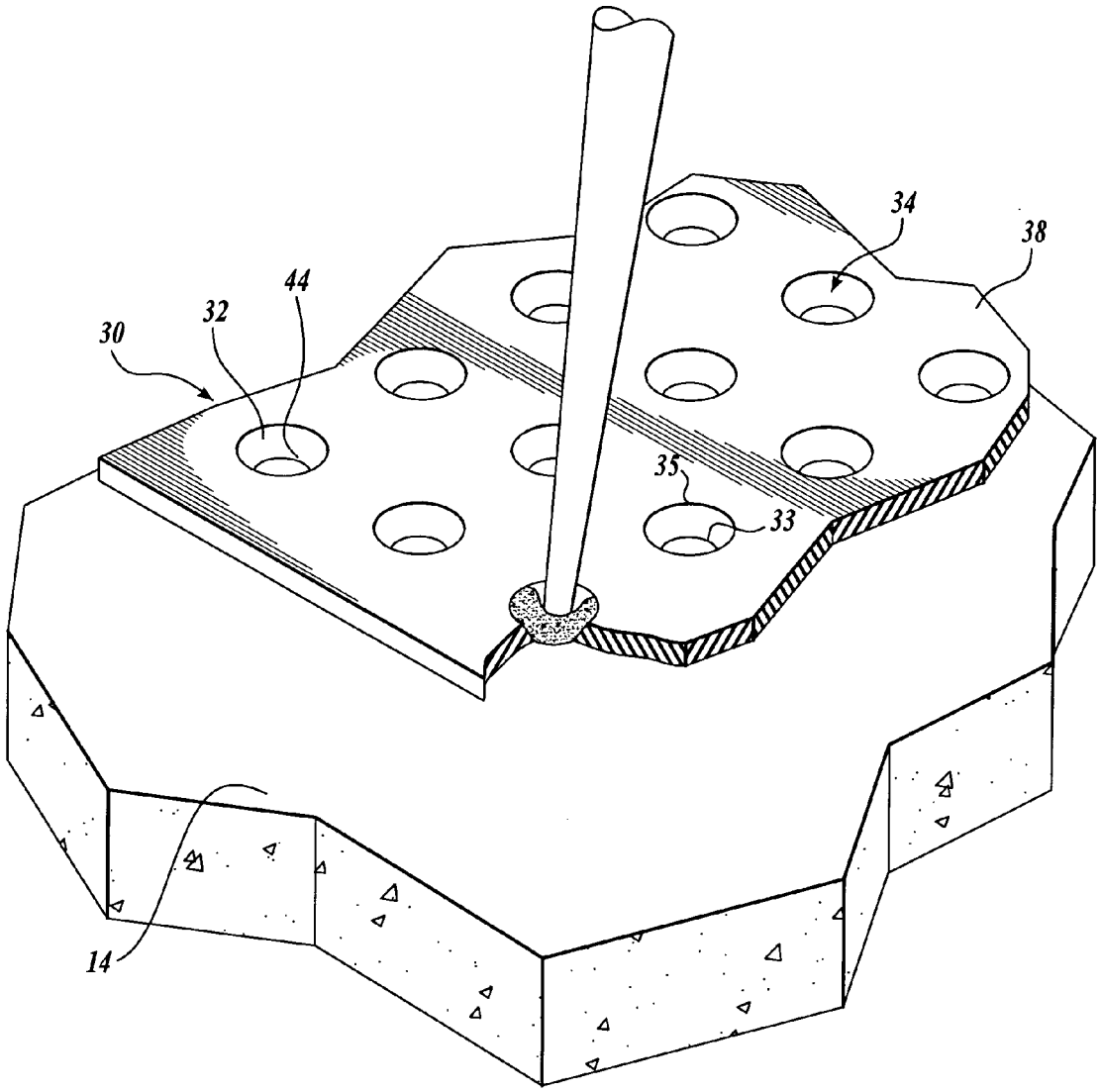
FIG. 2 is a top perspective view of a mat including a plurality of openings, wherein the mat is secured to a target substrate surface and a blended material is injected into the openings.

Now referring to FIG. 2, a mat 30 or similar element may be used to create the afore-described detectable warnings or truncated domes 16 on a substrate surface 14. The mat 30 may consist of either a rigid, flexible, or semi-flexible material, where the mat 30 may be formed using a molding technique, such as injection molding. The mold may include an upper and lower portion, and each portion of the mat mold may contain a portion of a mold cavity. The mold may also include inwardly extending projections that generally conform to the shape of the through holes 34 to form the through holes 34 during the molding process.

Referring to FIGS. 2 and 3C, each through hole 34 formed during the molding process represents a mold for forming the desired truncated domes 16 on the substrate surface 14. The through holes 34 are shown as being of an inverted frusto-conical shape and include a lower portion 44 defining a lower mat opening 33 and an upper portion 32 defining an upper mat opening 35. Preferably, the diameter of the lower mat openings 33 on the mat bottom surface 36 are about 0.50 inches to 0.90 inches and the diameter of the upper mat openings 35 on the mat top surface 136 are about 150% to 225% larger. However, it should be appreciated that through holes 34 of different sizes may be used to form various-sized detectible warnings 16. The through holes 34 may be arranged in a desired pattern to enhance the detectability of the target surface.

Now referring to FIGS. 2 and 3A, the truncated domes 16 are formed by first placing the mat 30 on a substrate surface 14. The mat 30 may include a sealant or adhesive surface (not shown) on the mat bottom surface 36 so that the mat 30 temporarily adheres to the substrate surface 14. After the mat 30 is placed upon the substrate surface 14, a viscous material 40 is injected into and fills each through hole 34. The material 40 is injected into the through holes 34 by using a manually operated squirt bottle or other manually operated or powered device. The material 40 may also be infused into the through holes 34 with a squeegee or similar device. After the material 40 has been injected or infused into all the through holes 34, the mat 30 is removed.

Referring to FIG. 3B, when the mat 30 is lifted from the substrate surface 14, the material 40 in the lower portion 44 of the through hole 34 falls downwardly through the lower mat opening 33 and adheres to the substrate surface 14 to form an initial base portion 42. The material 40 is of a consistency such that it slumps slightly when it falls to the substrate surface 14. At the same time the initial base portion 42 is being formed, the material 40 in the upper portion 32 of the through hole 34 is gravitationally forced downwardly and inwardly towards the center of the through hole 34. Referring to FIG. 3C, the material 40 from the upper portion 32 falls through the lower mat opening 33 onto the initial base portion 42 to form an initial annular top ring 50.

The material 40 in the initial annular ring 50 continues to fall inwardly and downwardly into the initial base portion 42 and causes the initial base portion 42 to slump further and become larger in size and diameter, as shown in FIG. 3D. The ring 50 continues to fall into the base portion 42 until a truncated dome 16 having a base diameter of approximately 0.9" to 1.4" is formed, as shown in FIG. 3E. The shape and size of the upper surface 26 of the truncated dome 16 is defined by the initial annular ring 50, which is formed by material 40 that falls through the lower mat opening 33 in the mat bottom surface 36. Thus, the dome upper surface 26 is roughly the same size and shape as the lower mat opening 33, or about 50 to 60 percent of the base 27 diameter.

As the material 40 ceases slumping, the material 40 cures to form the truncated dome 16, as shown in FIG. 3E. Once the truncated dome 16 has formed and cured, a final coat of viscous catalyzed material may be applied to the substrate surface 14 and the truncated domes 16 to smoothen any abnormalities or blemishes and help ensure an even appearance.

The truncated domes 16 of the present disclosure may be formed from material 40, which may comprise a methacrylate monomer blended with binders, pigments, and an abrasive. Ideally, the blended material has good abrasion resistance, chemical resistance, and longevity. The material 40 may be a viscous substance that is selected from the group consisting of polyester, polyethylene, polyurethane, polypropylene, polymethacrylate, polystyrene, polystyrene-acrylonitrile, polyvinylchloride, vinyl chloride acetate, nylon, rayon, acetate, acetate butyrate, rubber, methylmethacrolate, and polycarbonate. In one form of the present invention, the composition of the detectable warnings may be a methacrylate monomer blend having glass fiber binders, pigments, and reflective material. The use of a methacrylate monomer helps engender strong bond characteristics with normally encountered substrate surfaces such as asphalt, concrete, steel, and wood. The use of glass fibers enhances structural properties of the detectable warnings, increases traction, and reduces the amount of resin mixture needed for any given application. The percentage pigment chosen provides adequate color contrast under the provisions of the ADA. The use of reflective material such as glass spheres or beads enhances low light detection of the detectable warnings and further decreases the amount of monomer needed. Finally, the percentage abrasive not only increases the potential coefficient of friction of the warnings, but also provides additional strength as an aggregate and decreases the overall amount of resin needed for a given application.

Figure 4:
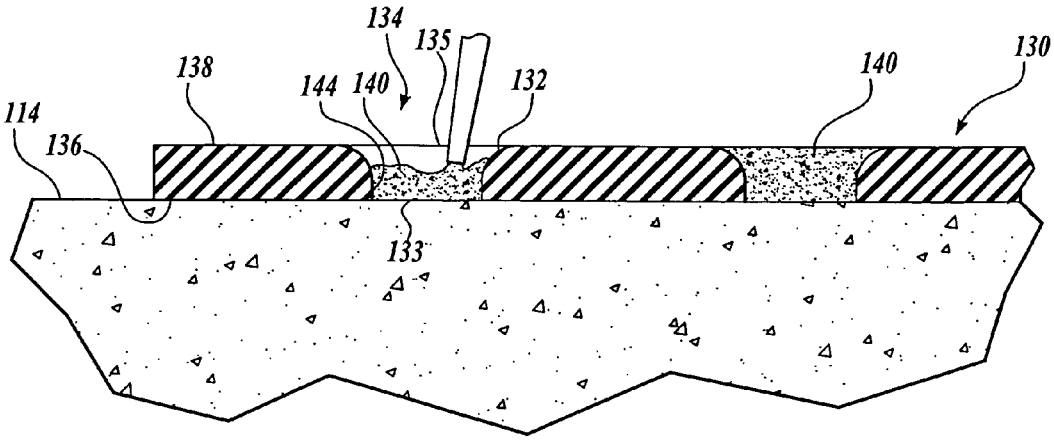
FIG. 4 is a cross-sectional view of blended material being injected into an alternate embodiment of the mat of FIG. 2.

Now referring to FIG. 4, wherein corresponding numerals increased by 100 refer to like elements, a further embodiment of the mat 130 is depicted. The mat 130 is substantially the same as mat 30 except that the through holes 134 include a lower generally circular portion 144 defining a lower mat opening 133 and an upper curved portion 132 defining an upper mat opening 135. The lower circular portion 144 extends from the mat bottom surface 136 at least partially through the mat thickness. The upper curved portion 312 extends from the lower circular portion 144 to the mat upper surface 138. The upper curved portion 132 extends upwardly and outwardly towards the mat top surface 138 so that the diameter of the upper mat opening 135 is larger than the diameter of the lower circular portion 144 and the lower mat opening 133.

Preferably, the diameter of the lower mat openings 134 (and the diameter of the lower circular portion 144) are about 0.50 inches to 0.90 inches and the diameter of the upper mat openings 135 on the mat top surface 136 are about 150% to 225% larger. The through holes 134 may be arranged in a desired pattern to enhance the detectability of the target surface.

The mat 130 is used to form truncated domes 116 (not shown) in substantially the same way as with mat 30. Each through hole 134 in the mat 130 represents a mold for forming the desired truncated domes 116 on the substrate surface 114. After the mat 130 is placed upon the substrate surface 114, a viscous material 140 is injected into and fills each through hole 134. After the material 140 has been injected or infused into all the through holes 134, the mat 130 is removed. When the mat 130 is lifted from the substrate surface 114, the material 40 in the lower circular portion 144 falls downwardly through the lower mat opening 134 and adheres to the substrate surface 114 to form an initial base portion 142.

The material 140 is of a consistency such that it slumps slightly when it falls to the substrate surface 114. At the same time the initial base portion 142 is being formed, the material 140 in the upper curved portion 132 of the through hole 134 is drawn downwardly and inwardly towards the center of the through hole 134. The material 140 from the upper curved portion 132 falls through the lower mat opening 133 and onto the initial base portion 142 to form an initial annular ring 150. The material 140 in the initial annular ring 150 continues to fall inwardly and downwardly into the initial base portion 142 and causes the initial base portion 142 to slump further and become larger in size and diameter. The ring 150 continues to fall into the base portion 142 until a truncated dome 116 having a base diameter of approximately 0.9" to 1.4" is formed. The shape and size of the upper surface 126 of the truncated dome 116 is defined by the initial annular ring 150, which is formed by material 140 that falls through the lower mat opening 133 in the mat bottom surface 136. Thus, the dome upper surface 126 is roughly the same size and shape as the lower mat opening 133, or about 50 to 60 percent of the base diameter. When the material 140 has ceased slumping, the material 140 cures to form the truncated dome 116.

While illustrative embodiments have been illustrated and described, it will be appreciated that various changes can be made therein without departing from the spirit and scope of the invention.

The invention claimed is:

1. A method for producing detectable warnings on substrate surfaces, comprising:

(a) providing a mat with a top surface and a bottom surface, the mat having a pattern of mat through holes extending through the mat, said mat through holes comprising a lower portion defining a lower mat opening in the bottom surface of the mat and an upper portion defining an upper mat opening in the upper surface of the mat, the upper mat opening larger in transverse dimension than the lower mat opening;

(b) placing the mat on a substrate surface, wherein the bottom surface of the mat is adjacent the substrate surface;

(c) injecting into the mat through holes a viscous substance having the ability to cure into a solid; and (d) removing the mat at the appropriate time to allow the viscous substance to fall downwardly through the mat through holes and form raised detectable warnings on the substrate surface.

2. The method of claim 1, wherein the mat through holes are of a generally inverted frusto-conical shape.

3. The method of claim 1, wherein the upper and lower mat openings are circular in shape.

4. The method of claim 3, wherein the upper portion of the through holes curve outwardly and upwardly toward the top surface of the mat.

5. The method of claim 1, wherein the method further comprises:

(a) allowing the viscous substance in the lower portion of the mat through holes to fall downwardly onto the substrate surface when the mat is removed;

(b) allowing the viscous substance in the upper portion of the mat through holes to fall downwardly and inwardly through the mat through holes onto the viscous substance on the substrate surface; and (c) allowing the viscous substance to slump on the substrate surface and form detectable warnings.

6. The method of claim 1, wherein the detectable warnings in final form may be generally in the shape of a dome having a lower surface with a diameter of at least 0.9" and no more than 1.4", a dome upper surface with a diameter of at least 50 percent of the base diameter and no more than 65 percent of the base diameter, and a height of at least 0.2".

7. The method of claim 1, wherein the detectable warnings are selected from shapes consisting of diamond shapes and dumbbell shapes.

8. The method of claim 1, wherein the mat through holes are arranged in a sinusoidal row, each row being in stacked relationship to another similar row.

9. The method of claim 1, wherein the viscous substance is a monomer.

10. The method of claim 1, wherein the step of preparing the viscous substance further comprises the step of combining at least one adjunct to create a viscous blend.

11. The method of claim 10, wherein the at least one adjunct comprises glass fibers, glass spheres, glass filaments, pigments, or abrasives.

12. The method of claim 1, wherein the viscous substance is selected from the group consisting of polyester, polyethylene, polyurethane, polypropylene, polymethacrylate, polystyrene, polystyrene-acrylonitrile, polyvinylchloride, vinyl chloride acetate, nylon, rayon, acetate, acetate butyrate, rubber, methylmethacrolate, and polycarbonate.

13. The method of claim 1, further comprising applying a layer of viscous material to the substrate surface and detectable warnings.

14. A method for producing detectable warnings on surfaces, comprising:

(a) providing a mat with a top surface and a bottom surface, the mat having a pattern of mat through holes that are generally in the form of an inverted frusto-conical shape such that each mat through hole has a lower portion defining a lower mat opening in the bottom surface of the mat and an upper portion defining an upper mat opening in the top surface of the mat, the upper mat opening larger in transverse dimension than the lower mat opening;

(b) placing the mat on a substrate surface, such that the bottom surface of the mat is adjacent the substrate surface;

(c) injecting into the mat through holes a viscous substance having the ability to cure into a solid;

(d) removing the mat from the substrate surface;

(e) allowing the viscous substance in the lower portion of the mat through holes to fall downwardly onto the substrate surface;

(f) allowing the viscous substance in the upper portion to fall downwardly and inwardly through the mat through holes and blend into the viscous substance on the substrate surface; and (g) allowing the viscous substance to slump on the substrate surface and cure to form detectable warnings.

15. The method of claim 14, wherein the detectable warnings are selected from a group consisting of circular, elongated ellipses, diamond-shaped and dumbbell-shaped.

16. The method of claim 14, wherein each detectable warning may have a transverse dimension of at least 0.9" and no more than 1.4" along the bottom of the detectable warning, a dome upper surface with a transverse dimension of at least 50 percent of the base diameter and no more than 65 percent of the base diameter, and a height of at least 0.2".

17. The method of claim 14, wherein the viscous substance is a monomer.

18. The method of claim 17, wherein the viscous substance is a two-part monomer that may have a catalytic reaction.

19. The method of claim 14, further comprising applying a layer of viscous material to the substrate surface and the detectable warnings.

* * * * *